US010927631B2

(12) United States Patent
Johnson

(10) Patent No.: US 10,927,631 B2
(45) Date of Patent: Feb. 23, 2021

(54) AXIAL VIBRATION TOOL FOR A DOWNHOLE TUBING STRING

(71) Applicant: 1751303 Alberta Ltd., Edmonton (CA)

(72) Inventor: Orren Johnson, Edmonton (CA)

(73) Assignee: 1751303 Alberta Ltd., Edmonton (CA)

( * ) Notice: Subject to any disclaimer, the term of this patent is extended or adjusted under 35 U.S.C. 154(b) by 859 days.

(21) Appl. No.: 15/368,386

(22) Filed: Dec. 2, 2016

(65) Prior Publication Data

US 2017/0159387 A1 Jun. 8, 2017

(30) Foreign Application Priority Data

Dec. 2, 2015 (CA) ..... 2913673

(51) Int. Cl.
*E21B 7/24* (2006.01)
*E21B 31/00* (2006.01)
*E21B 28/00* (2006.01)

(52) U.S. Cl.
CPC ..... *E21B 31/005* (2013.01); *E21B 7/24* (2013.01); *E21B 28/00* (2013.01)

(58) Field of Classification Search
CPC ..... E21B 28/00; E21B 31/005; E21B 7/24
See application file for complete search history.

(56) References Cited

U.S. PATENT DOCUMENTS 2,780,438 A 2/1957 Bielstein
4,819,745 A 4/1989 Walter
4,830,122 A 5/1989 Walter
4,890,682 A 1/1990 Worrall et al.
6,279,670 B1 * 8/2001 Eddison ..... E21B 4/02 175/107
6,439,318 B1 8/2002 Eddison et al.
6,508,317 B2 1/2003 Eddison et al.
7,219,726 B2 5/2007 Zheng et al.
9,366,100 B1 * 6/2016 Baudoin ..... E21B 28/00
2004/0055744 A1 * 3/2004 Zheng ..... E21B 4/18 166/249
2009/0223676 A1 * 9/2009 Eddison ..... E21B 21/103 166/381
2009/0266612 A1 * 10/2009 Allahar ..... E21B 31/005 175/55

* cited by examiner

*Primary Examiner* — Christopher J Sebesta
(74) *Attorney, Agent, or Firm* — Christensen O'Connor Johnson Kindness, PLLC

(57) ABSTRACT

There is provided an axial vibration tool with a flow control element, a rotary motor that provides an actuation force to the flow control element, a first flow path with at least a portion in fluid communication with the rotary motor and providing fluid to drive the rotary motor. A shock tool is carried by the outer housing and generates an oscillating force based on fluid pressure applied to an activation element. A high pressure flow path is between a source of high pressure fluid and the activation element, and a low pressure flow path is between a source of low pressure fluid and the activation element. The low pressure fluid source has a lower pressure than the high pressure fluid source. The flow control element controls flow through at least the high pressure path by applying pressure fluctuations to the activation element when actuated by the rotary motor.

22 Claims, 10 Drawing Sheets

AXIAL VIBRATION TOOL FOR A DOWNHOLE TUBING STRING

TECHNICAL FIELD

This relates to an axial vibration tool for use with a downhole tubing string in the drilling of oil and gas wells.

BACKGROUND

When drilling a well, a drill bit is generally mounted on the lower end of a drill string. As the drill bit drills the well, either the drill bit or the drill string may become stuck for a variety of reasons. Other downhole tools on the tubing string may also become stuck. It is well known in the industry that, by causing the downhole tool to vibrate, the frequency at which the downhole tool becomes stuck may be reduced, and in some cases, the drilling rate may be increased.

U.S. Pat. No. 7,708,088 (Allahar et al.) entitled "Vibrating downhole tool" describes a tool that vibrates a downhole tool during operation.

SUMMARY

According to an aspect, there is provided an axial vibration tool for a downhole tubing string, the axial vibration tool comprising an outer housing having a first end, a second end, and a longitudinal axis, a flow control element carried within the outer housing, a rotary motor connected to provide an actuation force to the flow control element when actuated, a first flow path that passes from the first end to the second end of the outer housing, at least a portion of the first flow path being in fluid communication with the fluid-powered rotary motor and providing a continual flow of fluid that actuates the fluid-powered rotary motor, a shock tool carried by the outer housing, the shock tool having an activation element, the shock tool generating an oscillating force along its longitudinal axis based on fluid pressure applied to the activation element of the shock tool, a high pressure flow path communicating fluid pressure between a source of high pressure fluid and the activation element, and a low pressure flow path communicating fluid pressure between a source of low pressure fluid and the activation element, the source of low pressure fluid being at a lower pressure than the source of high pressure fluid, wherein the flow control element controls flow through at least the high pressure flow path to apply pressure fluctuations to the activation element as the flow control element is actuated by the rotary motor.

According to another aspect, the activation element may be an annular piston positioned in a fluid chamber between the outer housing and an inner tubing string.

According to another aspect, the high pressure flow path may comprise a central bore defined by the rotary motor that is separate from the first flow path.

According to another aspect, the low pressure flow path may be a port in the outer housing that is alternatingly opened and closed by the flow control element.

According to another aspect, the first flow path may comprise the low pressure flow path, such that the fluid pressure is vented by the flow control element to the first flow path.

According to another aspect, the low pressure flow path may be downstream of the rotary motor.

According to another aspect, the first flow path may comprise the high pressure flow path.

According to another aspect, the low pressure flow path may be a port in the outer housing that is alternatingly opened and closed by the flow control element.

According to another aspect, the flow control element may be a rotary control element that is rotatably fixed within the outer housing, the flow control element having a rotational axis that is parallel to the longitudinal axis of the outer housing. The flow control element may comprise a tubular element having a sidewall and an internal bore, and the sidewall may comprise one or more radial ports that form part of the first flow path and that communicate fluid from the fluid-powered rotary motor to the internal bore of the tubular element. The sidewall of the flow control element may comprise fluid passages that extend axially through the sidewall to communicate fluid from the high pressure flow path to the activation element. The tubular element of the flow control element may comprise an end wall at an upstream end of the tubular element. The end wall may comprise a nozzle that communicates fluid pressure from high pressure flow path to the first flow path, the nozzle having a flow area. The flow area may be adjustable, and the nozzle may be closeable. The nozzle may act as a fluid bypass between the first flow path and the high pressure flow path, and closing the nozzle may activate the rotary motor, redirect fluid through the high pressure flow path, or both activate the rotary motor and redirect fluid through the high pressure flow path.

According to another aspect, the rotary motor may be powered by one of a turbine and a progressive cavity pump.

According to another aspect, the flow control element may control flow through the high pressure flow path and the low pressure flow path.

According to an aspect, there is provided a method of providing axial vibration to a downhole tool of a downhole tubing string, the method comprising the steps of in an axial vibration tool comprising an outer housing having a first end, a second end, and a longitudinal axis, a flow control element carried within the outer housing, a rotary motor connected to provide an actuation force to the flow control element when actuated, a first flow path that passes from the first end to the second end of the outer housing, at least a portion of the first flow path being in fluid communication with the rotary motor, a shock tool carried by the outer housing, the shock tool having an activation element, the shock tool generating an oscillating force along its longitudinal axis based on fluid pressure applied to the activation element of the shock tool, a high pressure flow path in fluid communication with a source of high pressure fluid and the activation element, and a low pressure flow path in fluid communication with a source of low pressure fluid and the activation element, causing fluid to flow along the low pressure flow path and the high pressure flow path, wherein the pressure of the low pressure flow path is less than the pressure of the high pressure flow path, and driving the rotary motor by providing a continual flow of fluid along the first flow path to actuate the flow control element, the flow control element controlling flow through at least the high pressure flow path to apply pressure fluctuations to the activation element.

According to another aspect, the low pressure flow path may be a port in the outer housing, and the method may further comprise the step of alternatingly opening and closing the port in the outer housing using the flow control element.

According to another aspect, the end wall may comprise a nozzle that communicates fluid pressure from high pressure flow path to the first flow path, the nozzle having a flow area, and the method may further comprise the step of adjusting the flow area.

According to another aspect, the flow control element may control flow through the high pressure flow path and the low pressure flow path In other aspects, the features described above may be combined together in any reasonable combination as will be recognized by those skilled in the art.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
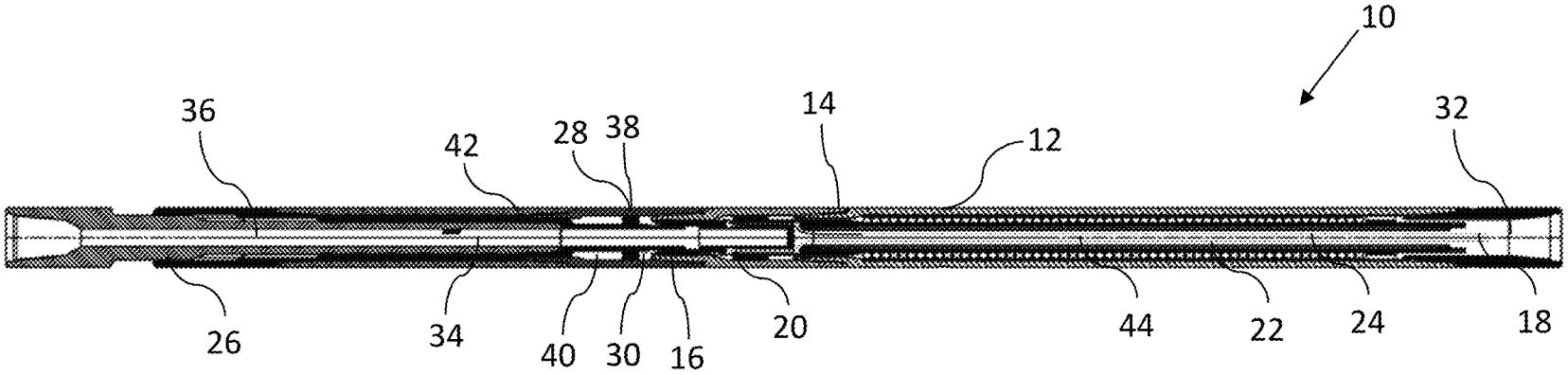
FIG. 1 is a side elevation view in section of an axial vibration tool in a first position.

An axial vibration tool generally identified by reference numeral 10 will now be described with reference to FIGS. 1 through 24.

Figure 2:
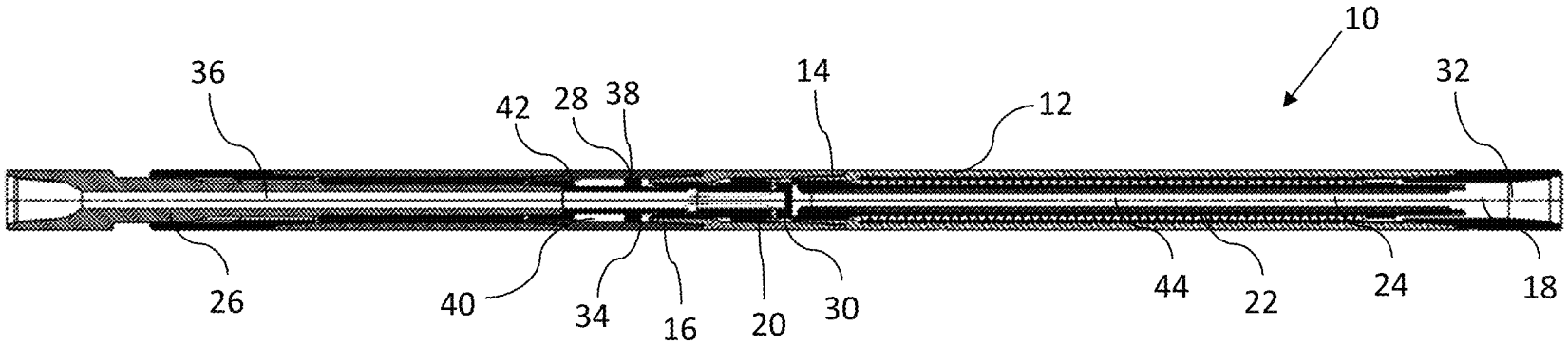
FIG. 2 is a side elevation view in section of the axial vibration tool shown in FIG. 1 in a second position.

Referring to FIG. 1 and FIG. 2, axial vibration tool 10, which is intended for use with a downhole tubing string (not shown), has an outer housing 12 with a first end 14, a second end 16, and a longitudinal axis 18. A flow control element 20 is used to control the flow of fluid through high and low pressure flow paths, as will be described below. As shown, flow control element 20 is rotatably fixed within outer housing 12 with a rotational axis that is parallel to longitudinal axis 18 of outer housing 12. Fluid-powered rotary motor 22 is connected to provide a rotary force to rotating control element 20 when rotary motor 22 is actuated. As shown, rotary motor 22 is powered by a turbine with multiple stages, but may be powered by other devices, such as a progressive cavity pump.

Rotary motor 22 is driven by a continuous fluid flow. This helps reduce the likelihood that the rotary tool will stall, as may occur in some prior art devices if the device stops in an intermediate position. In the depicted embodiment, there is a first flow path 24 passing through outer housing 12 from first end 14 to second end 16 that is in fluid communication with rotary motor 22 to provide the continual flow of fluid that drives fluid powered rotary motor 22. A shock tool 26 is carried by outer housing 12 with an activation element 28. As shown in FIG. 1 and FIG. 2, activation element 28 may be an annular piston 38 positioned in fluid chamber 40 between outer housing 12 and an inner tubing string 42. Shock tool 26 generates an oscillating force along its longitudinal axis based on fluid pressure applied to activation element 28 of shock tool 26. Other types of activation elements may be used that are capable of generating a vibration when subjected to a changing pressure.

High pressure flow path 30 communicates fluid pressure between source of high pressure fluid 32 and activation element 28, and low pressure flow path 34 communicates fluid pressure between source of low pressure fluid 36 and activation element 28. High pressure flow path 30 may have a central bore 44 defined by rotary motor 22 that is separate from first flow path 24. Source of low pressure fluid 36 is at a lower pressure than source of high pressure fluid 32. Rotating control element 20 alternatingly restricts flow through high pressure flow path 30, as shown in FIG. 2, and low pressure flow path 34, as shown in FIG. 1, in order to apply pressure fluctuations to activation element 28. As will be described in greater detail below, in some cases first flow path 24 may be the same as low pressure flow path 34, in which case the fluid pressure is vented by rotating control element 20 into first flow path 24. In this case, low pressure flow path 34, or first flow path 24, is downstream of rotary motor 22. In other cases, first flow path 24 may be the same as high pressure flow path 30. In some cases, low pressure flow path 34 is a port in outer housing 12 that is alternatingly opened and closed by rotating control element 20.

FIG. 3 through FIG. 16 depict various embodiments in which a rotating control element 20 has a tubular element 46 with a sidewall 48 and an internal bore 50. As will be discussed below, tool 10 and rotating control element 20 in particular may be designed to apply high and low pressures to activation element 28 in different ways. In particular, control element 20 is depicted as having some common features among the various embodiments. For example, sidewall 48 may have one or more radial ports 52 that form part of first flow path 24 and that communicate fluid from rotary motor 22 to internal bore 50 of tubular element 46. As shown, radial ports 52 may be nozzles, which may be removable and replaceable, such as for ease of servicing, to allow different materials to be used for ports 52, or to change the flow area available through ports 52. Sidewall 48 of rotating control element 20 may also have fluid passages 54 that extend axially through sidewall 48 to communicate fluid from high pressure flow path 30 to activation element 28. By controlling the flow though the various flow passages and ports, it is possible to alternatingly expose activation element 28 to high and low pressures, which in turn causes tool 10 to vibrate.

Figure 13:
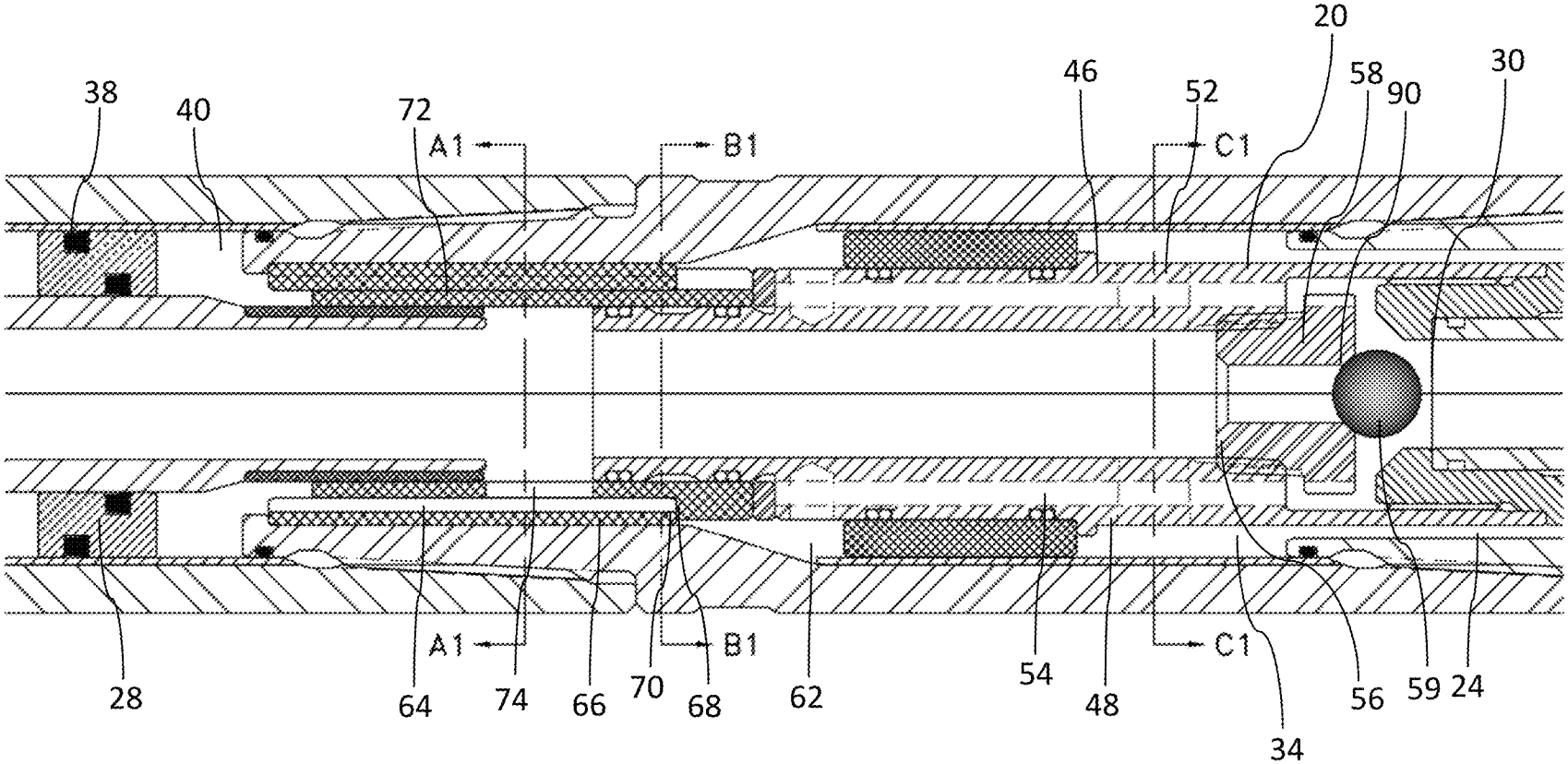
FIG. 13 is a side elevation view in section of a portion of a second variation of an axial vibration tool.

Tool 10 may also be modified in order to provide other ways of controlling the operation of tool 10, such as the frequency and/or amplitude of the vibrations. For example, referring to FIGS. 5, 6, 9 and 13, tubular element 46 of rotating control element 20 may have an end wall 56 at an upstream end of tubular element 46 with a nozzle 58 that communicates fluid pressure from high pressure flow path 30 to first flow path 24. Nozzle 58 has a flow area 60 which may be adjustable, such as by replacing nozzles 58 in FIGS. 5 and 6, or closeable, such as by dropping a ball 59 or other plug (not shown) to engage nozzle 58 as shown in FIG. 13, depending on the desired application. Nozzle 58 may act as a fluid bypass between first flow path 24 and high pressure flow path 30. Depending on the size of nozzle 58, it may act as a bypass to rotary motor 22, such that closing nozzle 58 will activate rotary motor 22, or it may be used to redirect fluid through high pressure flow path 30, or both. Alternatively, nozzle 58 may be sized to create a desired pressure differential, which allows the user some control over the vibrations applied to tool 10.

Specific embodiments in which high and low pressures are alternatingly applied to activation element 28 will now be described. The descriptions are given in terms of designs with high, medium, and low pressures. It will be understood that these terms are used with respect to the embodiments described herein for convenience in comparing the various examples. In particular, any of the examples will always have a high and low pressure in operation, although the pressures or pressure differential may be different when compared with another example described herein. There may also be other design changes that could be made to result in high and low pressures being applied within tool 10 to create vibrations. For example, in the embodiments described below, the preferred method is opening and closing passages to alternatingly expose activation element 28 to higher and lower pressures. It may also be possible to apply a continuous flow of fluid to activation element 28 at either a high or low pressure, and open or close a passage to either increase or decrease the pressure applied to activation element 28.

High Pressure to Medium Pressure Embodiment

Figure 3:
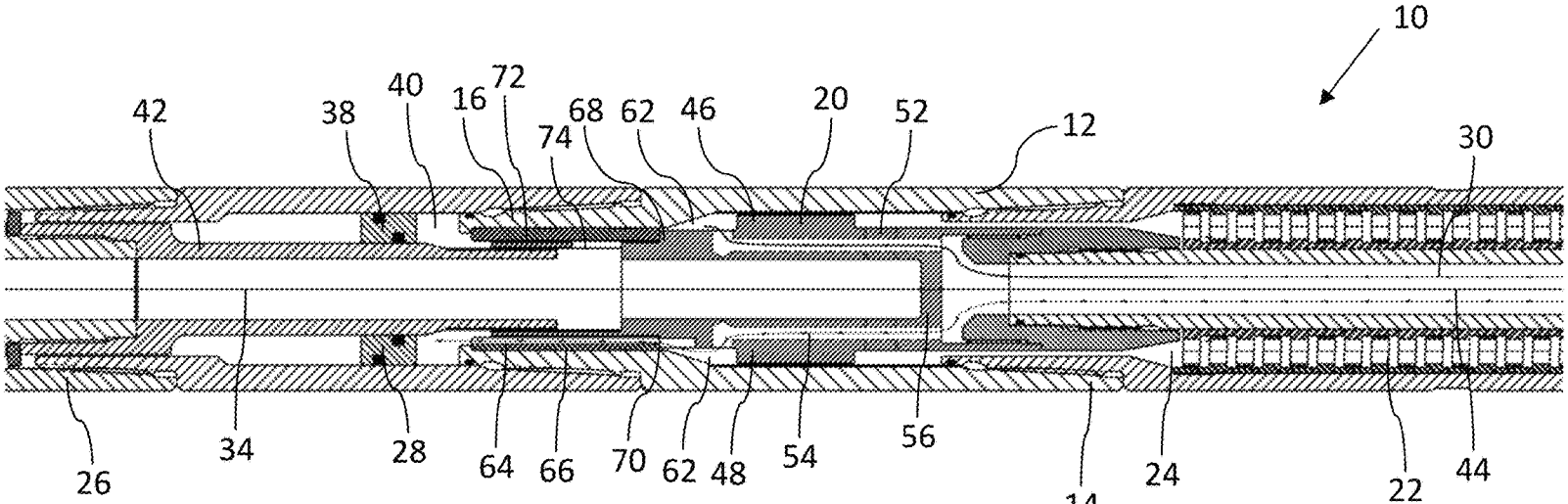
FIG. 3 is a side elevation view in section of a portion of an axial vibration tool in a first position.
Figure 4:
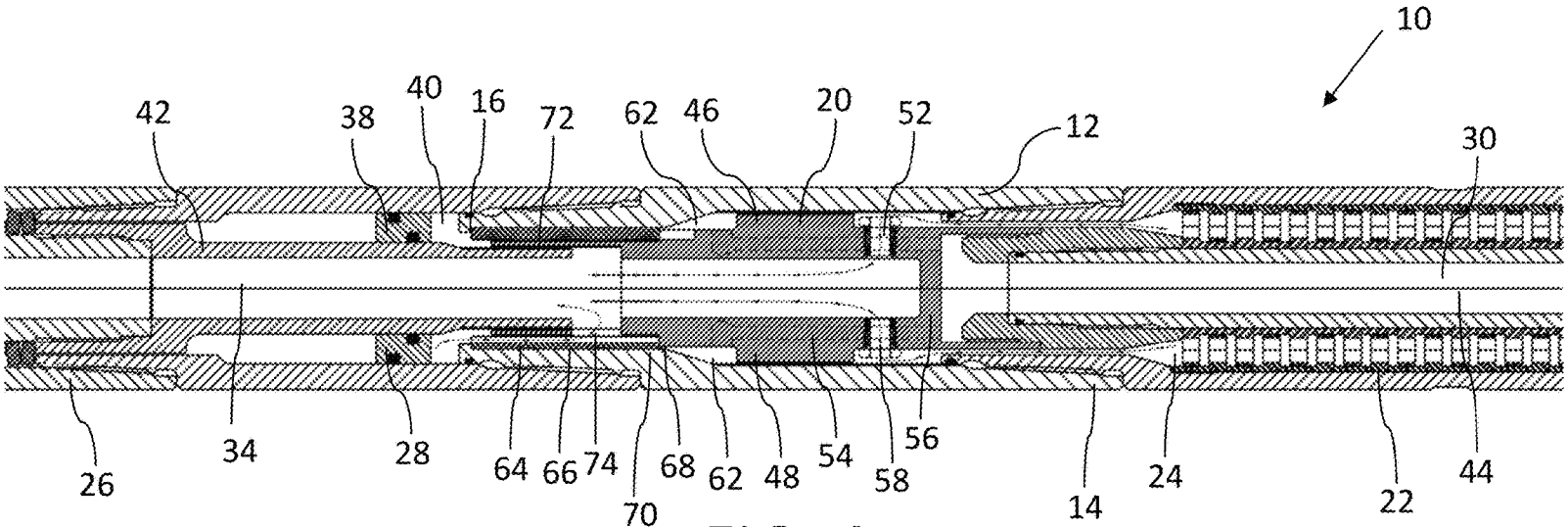
FIG. 4 is a side elevation view in section of the portion of the axial vibration tool shown in FIG. 3 in a second position.

Referring to FIG. 3 and FIG. 4, a first embodiment of axial vibration tool 10 will be described in which a high pressure and a medium pressure are alternatingly applied to activation element 28.

Referring to FIG. 3, axial vibration tool 10 has rotary motor 22, which may be a turbine or positive displacement motor, attached at first end 14 of outer housing 12. There are two flow paths through the rotary motor 22 portion of the tool; the first flow path is represented by reference numeral 24 and passes through the turbine or positive displacement portion of the motor to provide a continual flow of fluid that actuates the rotary motor 22. The second flow path is represented by reference numeral 30, and passes through central bore 44. In this embodiment, first flow path 24 is a low pressure flow path in communication with flow path 34, and second flow path 30 is a high pressure flow path. FIG. 3 shows a first position of rotating control element 20, with high pressure flow path 30 in fluid communication with fluid chamber 40. In this position, high pressure fluid flows through central bore 44, and is directed into fluid passages 54 in sidewalls 48 of tubular element 46. The high pressure fluid is able to flow through radial cavity 62, through fluid path 64, and into fluid chamber 40, where pressure is applied against activation element 28. Low pressure fluid flows through radial ports 52, and continues through low pressure flow path 34 to the end of the tool. As rotary motor 22 is actuated, rotating control element 20 is rotated. Referring to FIG. 4, rotating control element 20 is in a second position. In this position high pressure flow path 30 flows into radial cavity 62, and is stopped by the seal of tubular element 46 against sealing element 66. Shoulder 68 of tubular element 46 engages shoulder 70 of sealing element 66 as shown. This also turns sleeve 72 of sealing element 66 such that opening 74 in sleeve 72 is in communication with fluid path 64. This allows fluid chamber 40 to be in fluid communication with low pressure flow path 34. As fluid chamber 40 was filled by high pressure fluid in the first position, fluid chamber 40 vents into low pressure flow path 34, reducing the pressure on activation element 28. Rotating control element 20 is rotated between these first and second positions, causing alternating high and low pressure fluid to fill fluid chamber 40, resulting in pressure fluctuations being applied to activation element 28, and causing axial vibration through shock tool 26.

Medium Pressure to Low Pressure Embodiment

Figure 5:
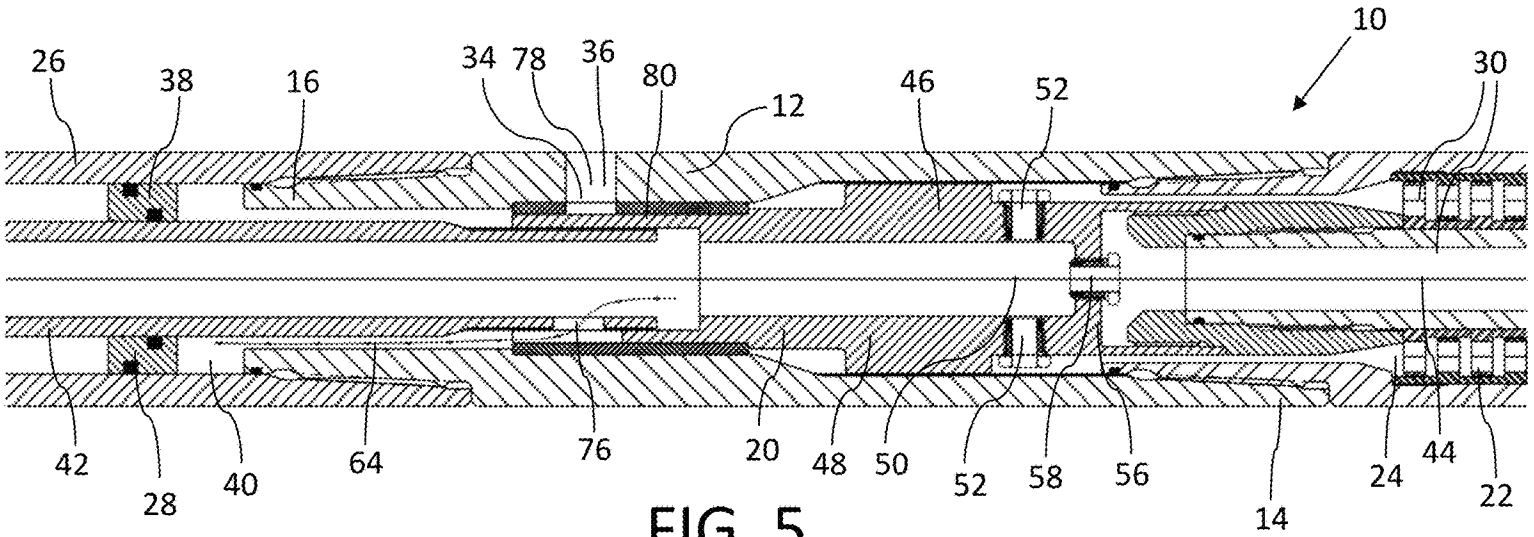
FIG. 5 is a side elevation view in section of a portion of an alternate axial vibration tool in a first position.
Figure 6:
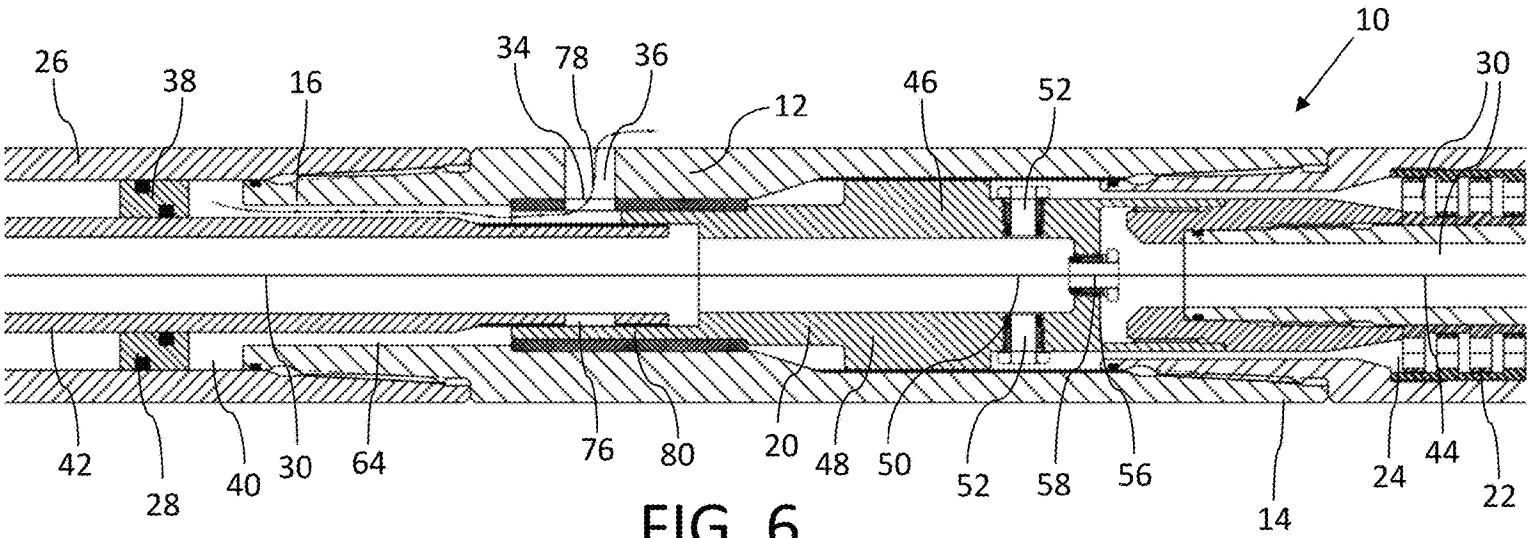
FIG. 6 is a side elevation view in section of the portion of the axial vibration tool shown in FIG. 5 in a second position.

Referring to FIG. 5 and FIG. 6, a second embodiment of axial vibration tool 10 will be described. Rotary motor 22, as previously described, is attached at first end 14, and has two flow paths, one being flow path 24 that passes through the turbine or positive displacement portion of the motor, and the second through central bore 44. In this embodiment, both flow paths are supplied by a source of high pressure fluid, and both flow path 24 and the flow path through central bore 44 are part of high pressure flow path 30. In this embodiment, tubular element 46 has a nozzle 58 in end wall 56, in addition to radial ports 52. As the fluid paths meet after passing through nozzles 52 and 58, which is immediately after passing through motor 22, the pressure differential across motor 22, and therefore the rotary speed of motor 22, can be controlled by controlling the relative flow area between the two paths. In particular, as the high pressure fluid which passes through flow path 24 powers the turbines, there will be a pressure drop in this portion of the flow, resulting in the fluid that passed through central bore 44 being at a higher pressure. By adjusting the flow area of ports 52 relative to nozzle 58, the pressure differential can be adjusted such that the pressure in internal bore 50 of tubular element 46 can be controlled as well as the back pressure on rotary motor 22, such that the rotational velocity or the speed at which the motor turns tubular element 46 will be adjusted.

After passing through ports 52 and nozzle 58, the fluid then flows from internal bore 50, through opening 76 in inner tubing string 42, through fluid path 64, to fill fluid chamber 40 and apply pressure against activation element 28. In this embodiment rotating control element 20 has an external port 78 in fluid communication with the low pressure drilling fluid flowing exterior to the tool. In this case, the low pressure drilling fluid surrounding the tool is the source of low pressure fluid 36. As shown in FIG. 5, external port 78 is sealed by sleeve portion 80 of tubular element 46. When rotating control element 20 is rotated, sleeve 80 rotates to block opening 76 and to allow flow through external port 78, as shown in FIG. 6. This seals the high pressure flow path 30 from fluid chamber 40, and creates fluid communication between fluid chamber 40 and the low pressure drilling fluid surrounding the tool, allowing fluid chamber 40 to vent into low pressure flow path 34, reducing the pressure on activation element 28. As described with the previous embodiment, rotating control element 20 rotates between these two positions, in this case, alternatingly sealing off opening 76 and opening 78, causing alternating high and low pressure fluid to fill fluid chamber 40, resulting in pressure fluctuations being applied to activation element 28, and causing axial vibration through shock tool 26.

High Pressure to Low Pressure Embodiment

Figure 7:
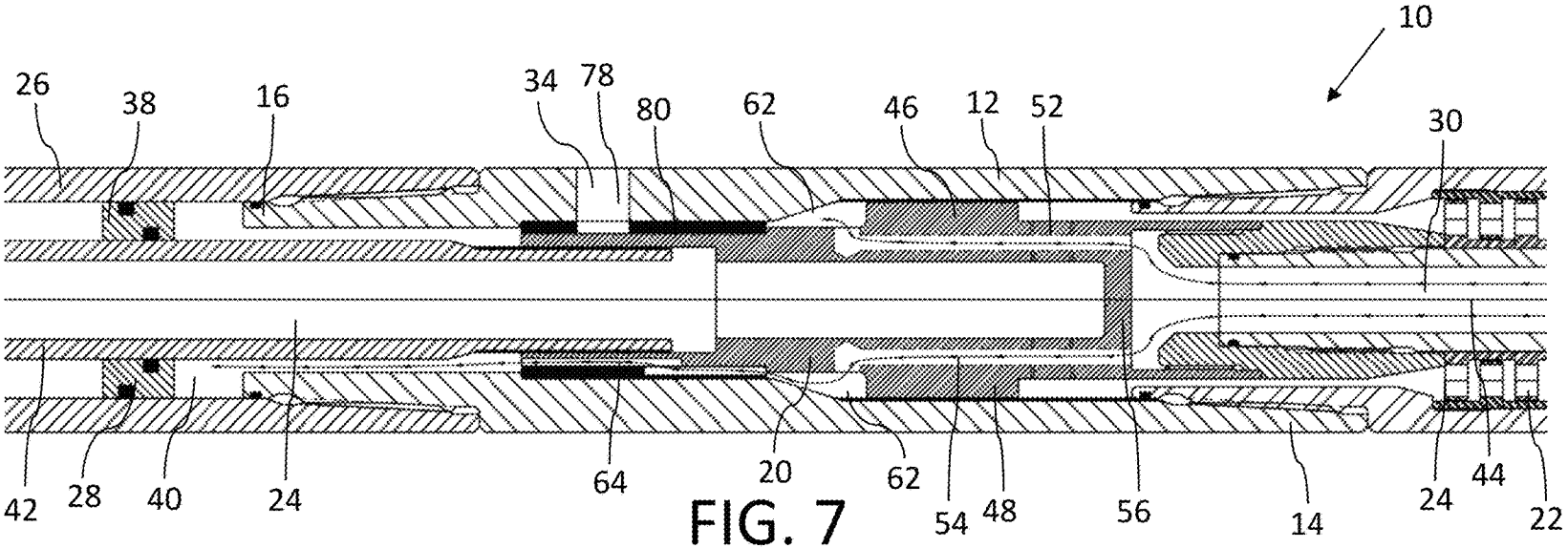
FIG. 7 is a side elevation view in section of a portion of an additional alternate axial vibration tool in a first position.
Figure 8:
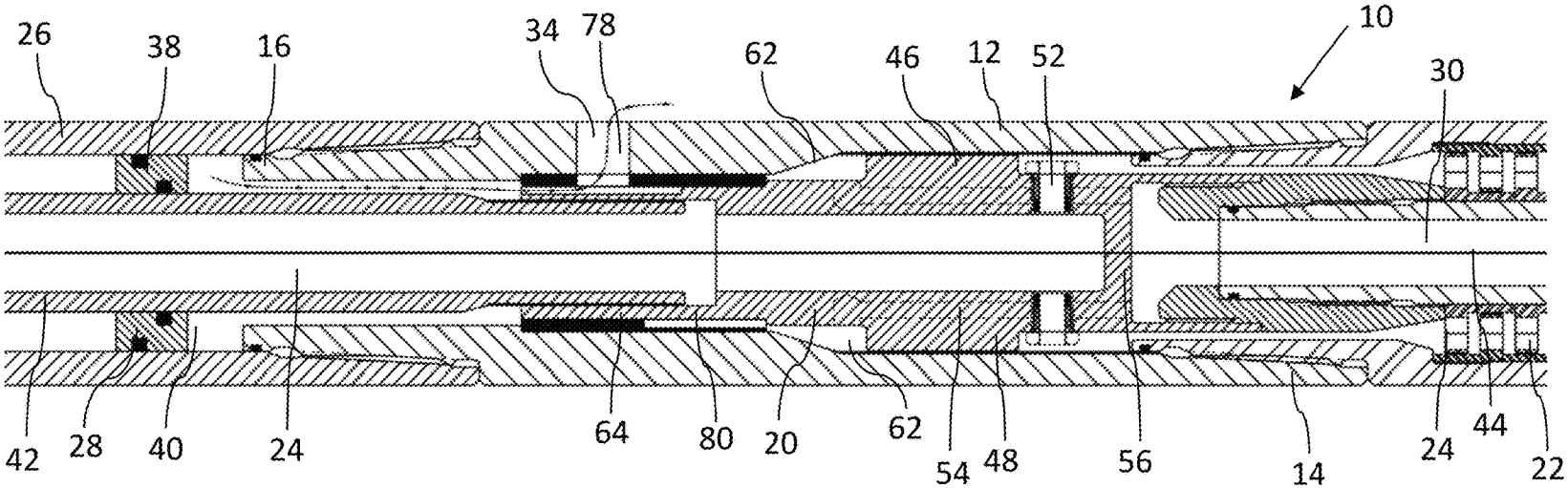
FIG. 8 is a side elevation view in section of the portion of the axial vibration tool shown in FIG. 7 in a second position.

Referring to FIG. 7 and FIG. 8, a third embodiment of axial vibration tool 10 will be described. Axial vibration tool 10 has a rotary motor 22, as previously described, having two flow paths; first flow path 24 passing through the turbine or positive displacement portion of the motor and second path through central bore 44. In this embodiment, the high pressure flow path 30 is the path through central bore 44. This pressure is described as "high" relative to the embodiment in FIGS. 5 and 6, in which there is a pressure drop across rotary motor 22 prior to energizing activation element 28. High pressure fluid flows through central bore 44, and is directed into fluid passages 54 in sidewalls 48 of tubular element 46. Fluid flows through radial cavity 62, along fluid path 64, and into fluid chamber 40, where pressure is applied against activation element 28. Rotating control element 20 has external port 78 in fluid communication with the low pressure drilling fluid flowing exterior to the tool. The low pressure drilling fluid surrounding the tool is the source of low pressure fluid 36. As shown in FIG. 7, external port 78 is sealed by sleeve portion 80 of tubular element 46. In this embodiment, first flow path 24 is neither of low pressure flow path 34 and high pressure flow path 30, and is instead a separate path that does not communicate with fluid chamber 40 when rotating control device 20 is in any position. As shown, the fluid in flow path 24 flows through rotary motor 22 to turn rotating control element 20, passes through radial ports 52, which may be nozzles 58 as shown, and continues through flow path 24 to the end of the tool. When rotating control element 20 is rotated, as shown in FIG. 8, there is no change to flow path 24. Sleeve portion 80 of tubular element 46 is rotated to block fluid path 64, as shown, and external port 78 is opened to allow flow through external port 78. This allows fluid communication between fluid chamber 40 and the low pressure drilling fluid surrounding the tool, allowing fluid chamber 40 to vent into low pressure flow path 34, reducing the pressure on activation element 28. Rotating control element 20 rotates between these two positions, alternatingly sealing off fluid path 64 and opening 78, causing alternating high and low pressure fluid to fill fluid chamber 40, resulting in pressure fluctuations being applied to activation element 28, and causing axial vibration through shock tool 26.

Nozzle Variation

Figure 9:
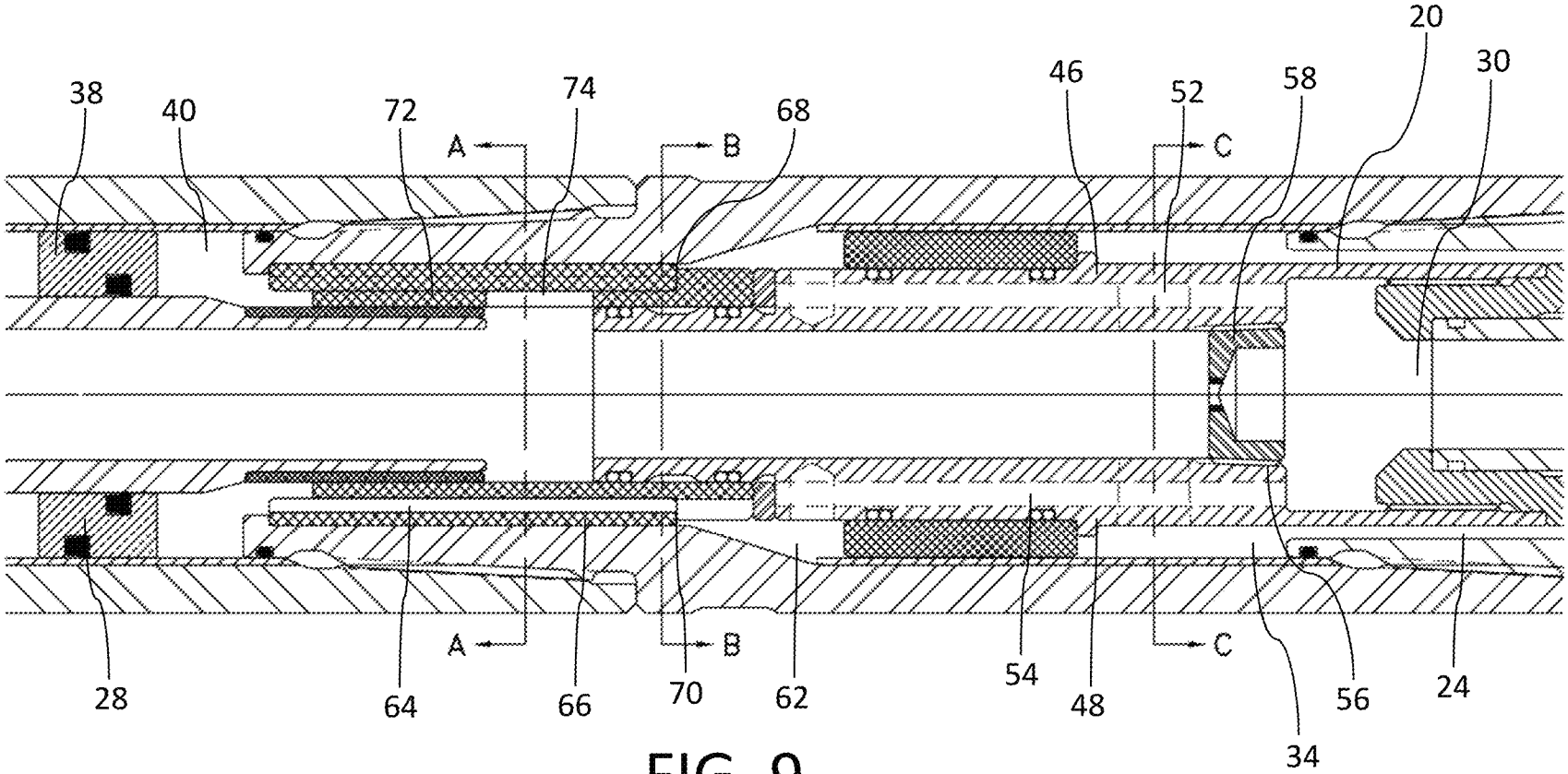
FIG. 9 is a side elevation view in section of a portion of a variation of an axial vibration tool.

Referring to FIG. 9 through FIG. 12, a first variation of axial vibration tool 10 will be described. Referring to FIG. 9, in this variation, end wall 56 of tubular element 46 is at least partially replaced by an adjustable nozzle 58. Adjustable nozzle 58 may be set to different diameters prior to use, and may be removed entirely from tool 10 if desired. FIG. 9 depicts adjustable nozzle 58 as a modification of the rotating control element 20 shown in FIG. 3 and FIG. 4. However, adjustable nozzle 58 may be used with any of the embodiments described, or with other embodiments, as will be understood by those skilled in the art. Adding adjustable nozzle 58 to the embodiment shown in FIG. 3 and FIG. 4 would allow a user to increase or decrease the back pressure on the first flow path 24 through rotary motor 22 by increasing or decreasing the proportion of the high pressure flow path 30 allowed to mix with the low pressure flow path 34 within internal bore 50. Increasing the back pressure on the first flow path 24 would decrease the frequency of the rotation. As well, increasing the pressure of low pressure flow path 34 by the addition of high pressure fluid would decrease the pressure differential between the two flow paths, thereby reducing the difference between the two pressures experienced in fluid chamber 40, and decreasing the intensity of the vibrations through shock tool 26. As previously discussed, the embodiments in FIGS. 5 and 6 can be configured to have different sized nozzles 58, allowing for different pressure differentials between the flow path through rotary motor and central bore 44. The use of an adjustable nozzle 58 allows nozzle 58 in end wall 56 to be sized differently between each run of the tool. In the embodiment shown in FIG. 7 and FIG. 8, the addition of adjustable nozzle 58 would allow for adjustment to the back pressure acting on the first flow path 24 through the rotary motor, thereby decreasing the frequency of the rotation of the rotating control element.

Figure 11:
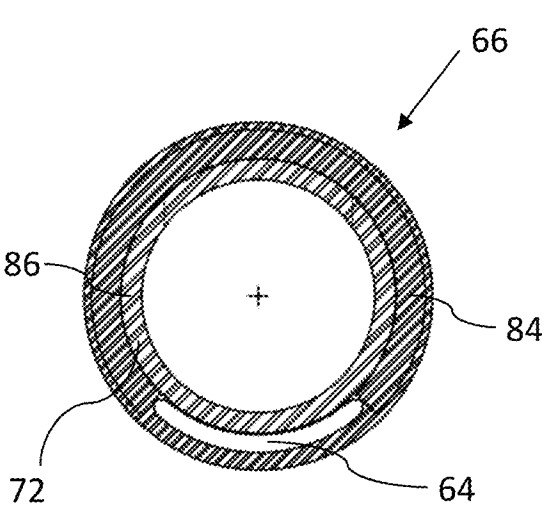
FIG. 11 is a top plan view in section of the variation of an axial vibration tool shown in FIG. 9, taken along the line B-B of FIG. 9.
Figure 10:
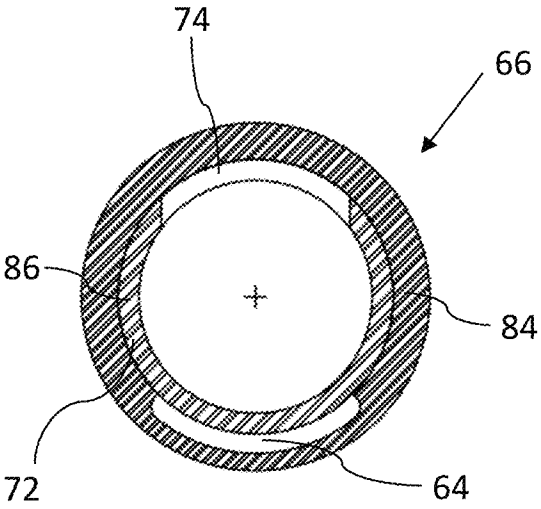
FIG. 10 is a top plan view in section of the variation of an axial vibration tool shown in FIG. 9, taken along the line A-A of FIG. 9.
Figure 12:
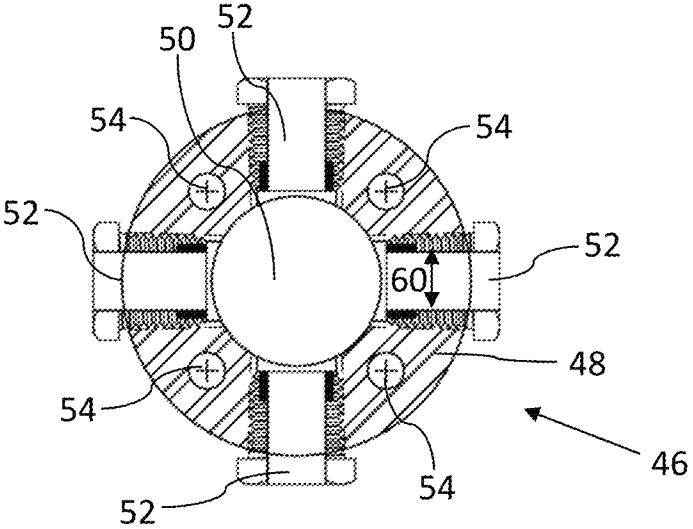
FIG. 12 is a top plan view in section of the variation of an axial vibration tool shown in FIG. 9, taken along the line C-C of FIG. 9.

Another example of an adjustable nozzle 58 is shown in FIG. 9. Referring to FIG. 10 and FIG. 11, cross sections of sealing element 66 along the lines A-A and B-B respectively of FIG. 9 are shown. Fluid path 64 through sealing element 66 is formed between the outer section 84 of sealing element 66, and the inner section 86 of sealing element 66, which forms sleeve 72 of sealing element 66. Opening 74 is formed in sleeve 72 as shown. FIG. 12 shows a cross section of tubular element 46 along the line C-C of FIG. 9. As shown, tubular element 46 has four radial ports 52 having nozzles 52, as well as four fluid passages 54 in side wall 48 of tubular element 46. It will be understood by those skilled in the art that tubular element 46 may have any number of radial ports 52 having nozzles 52, and any number of fluid passages 54. Nozzles 52 have a flow area 60 that can have varying sizes depending on the application and the desired intensity and frequency of pulses, as previously described. By adjusting the flow area of nozzle 58, the pressure differential between the high and low pressures applied to activation element 28 may be controlled and the magnitude of the variations may be adjusted. By adjusting the flow area through ports 52, the pressure differential across rotary motor 22 can be changed and the frequency of the vibrations can be adjusted.

Ball Variation

Figure 15:
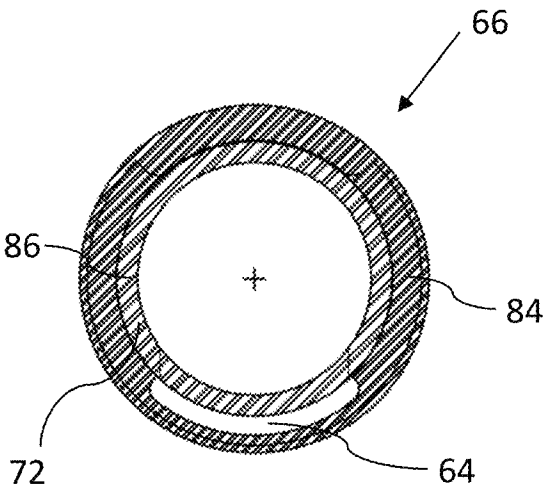
FIG. 15 is a top plan view in section of the variation of an axial vibration tool shown in FIG. 13, taken along the line B-B of FIG. 13.
Figure 16:
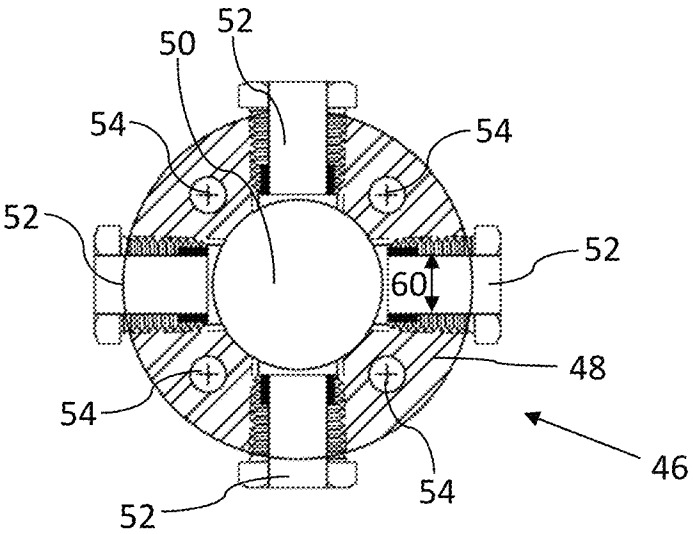
FIG. 16 is a top plan view in section of the variation of an axial vibration tool shown in FIG. 13, taken along the line C-C of FIG. 13.
Figure 14:
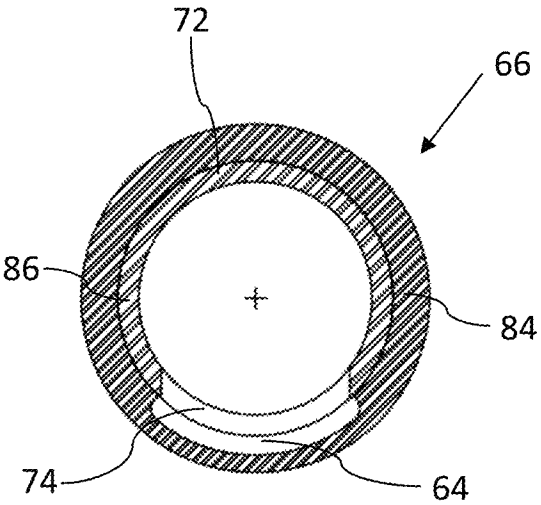
FIG. 14 is a top plan view in section of the variation of an axial vibration tool shown in FIG. 13, taken along the line A-A of FIG. 13.
Figure 18:
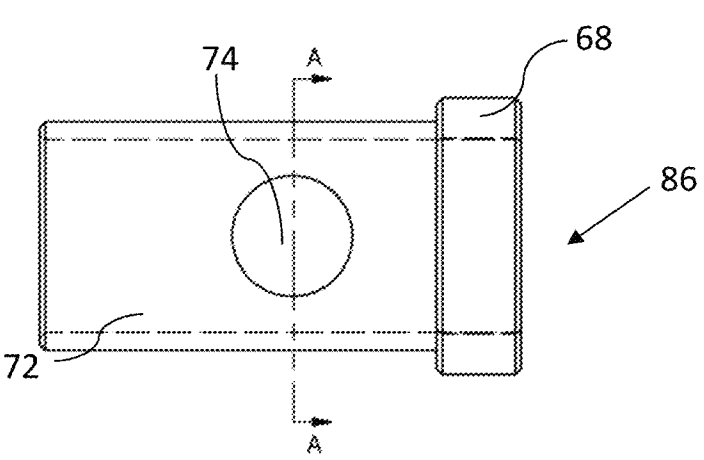
FIG. 18 is a side elevation view of the rotating valve element shown in FIG. 17.
Figure 21:
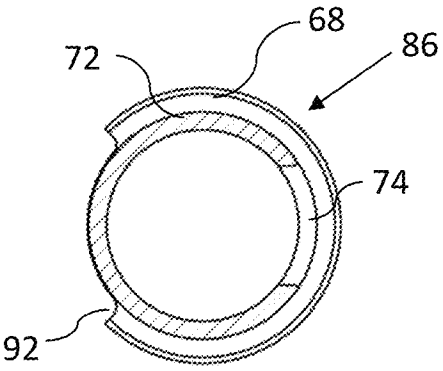
FIG. 21 is a front elevation view in section of the rotating valve element shown in FIG. 17, taken along the line A-A of FIG. 18.
Figure 20:
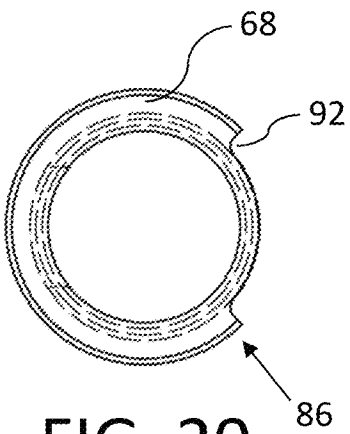
FIG. 20 is a front elevation view of the rotating valve element shown in FIG. 17.
Figure 17:
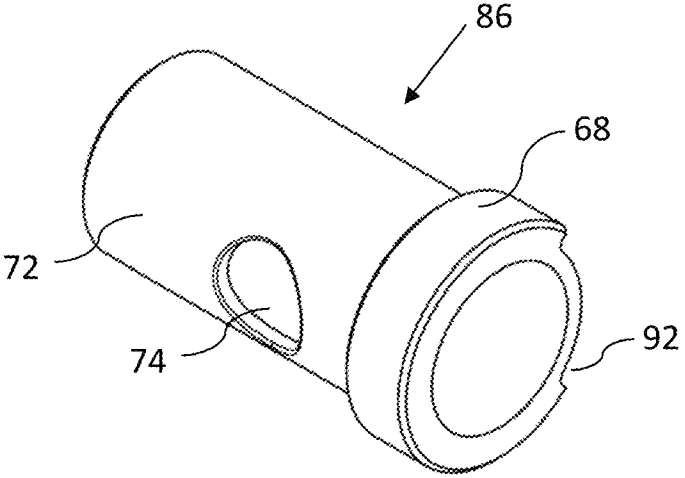
FIG. 17 is a perspective view of a rotating valve element.
Figure 19:
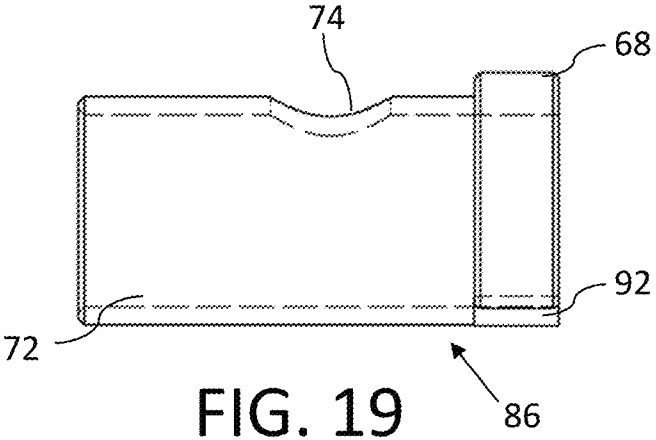
FIG. 19 is a top plan view of the rotating valve element shown in FIG. 17.

Referring to FIG. 13 through FIG. 16, a second variation of axial vibration tool 10 will be described. Referring to FIG. 13, in this variation, end wall 56 of tubular element 46 receives a ball 88, which sealingly engages an opening 90 in end wall 56 as shown. In this variation, with no ball in place, opening 90 is in fluid communication with high pressure flow path 30, such that first flow path 24, high pressure flow path 30, and low pressure flow path 34 are all in communication through nozzles 52. As there will be no pressure differential across rotary motor 22, it will not rotate, and there will be no movement of activation element 28. This allows the tool to be used as a non-vibrating tool when vibration is not required, for example, during the first portion of drilling where the path or material that is encountered by the drill do not require the use of axial vibration. Once axial vibration is desired or required, ball 88 can be deployed into axial vibration tool 10 through central bore 44. Ball 88 then seats on opening 90 in nozzle 58, sealing opening 90, and separating high pressure flow path 30 from low pressure flow path 34. Axial vibration tool 10 then operates as previously described. Referring to FIG. 14 and FIG. 15, cross sections of sealing element 66 along the lines A-A and B-B respectively of FIG. 13 are shown. In comparison with FIG. 10 and FIG. 11, sleeve 72 has been rotated such that opening 74 now communicates with fluid path 64, as shown in FIG. 13, allowing low pressure fluid to enter fluid chamber 40 and purging the pressure caused by the high pressure fluid. FIG. 16 shows a cross section of tubular element 46 along the line C-C of FIG. 13, as previously described with reference to FIG. 12.

Sealing Element

Figure 23:
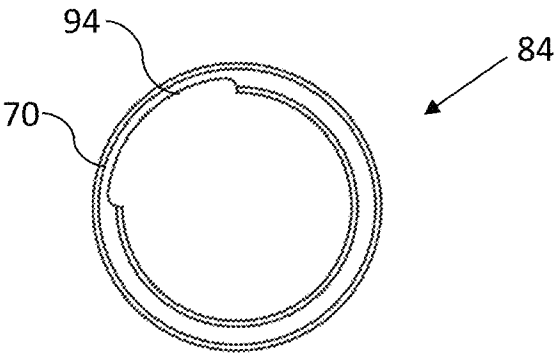
FIG. 23 is a front elevation view of the stationary valve element shown in FIG. 22.
Figure 24:
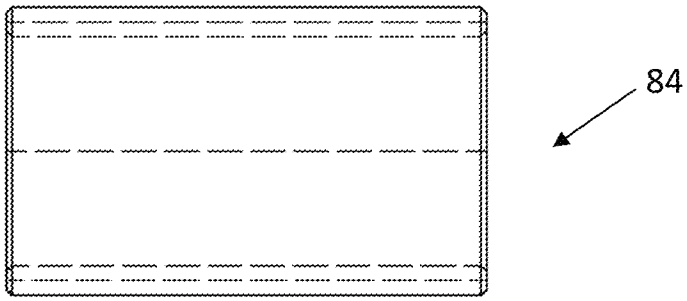
FIG. 24 is a side elevation view of the stationary valve element shown in FIG. 22.
Figure 22:
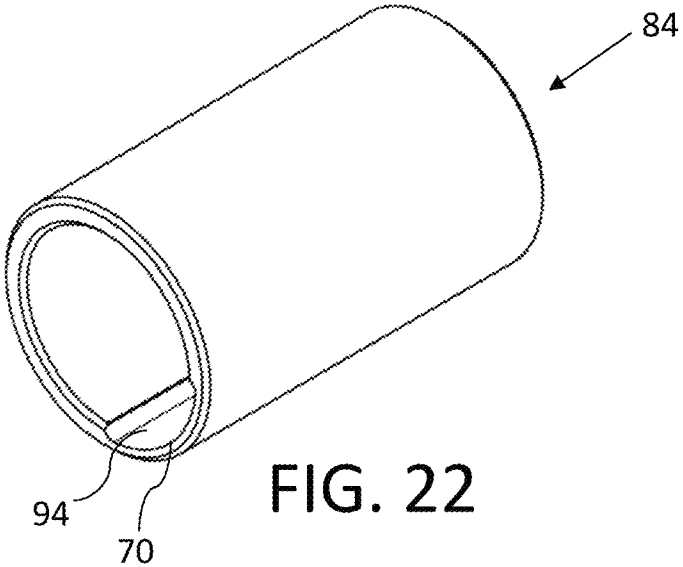
FIG. 22 is a perspective view of a stationary valve element.

Referring to FIG. 17 through FIG. 24, an example of sealing element 66 is shown. It will be understood that sealing element 66 may take a variety of forms, as previously described with reference to the particular embodiments of axial vibration tool 10, and may also take other forms, as will be understood by those skilled in the art. It will be understood that the term sealing includes paths where some leakage is anticipated. In this embodiment, sealing element 66 has an inner section 86 that is a rotating valve element, and an outer section 84 that is a stationary valve element, as shown in FIG. 9 through FIG. 16. Referring to FIG. 17 through FIG. 21, sealing element 66 has an inner section 86. Sleeve 72 forms a portion of inner section 86. Sealing element 66 has a shoulder 68 on inner section 86 as well as an opening 92, which forms part of fluid path 64 when installed. Inner section 86 also has opening 74. As shown, opening 92 is disposed opposite from opening 74, resulting in openings 92 and 74 alternatingly engaging fluid path 64, thereby allowing for switching between the fluid flows. Referring to FIG. 22 through FIG. 24, sealing element 66 also has an outer section 84 that is a stationary valve element. Outer section 84 has an opening 94 that forms part of fluid path 64, and alternately communicates with openings 92 and 74 on inner section 86. Outer section 84 also has shoulder 70, which engages with shoulder 68 of inner section 86. Inner section fits 86 within outer section 84 as shown in FIG. 9 through FIG. 16. Rotating valve element formed by inner section 86 is engaged by tubular element 46, and is rotated by rotating control element 20 within inner section 86 to provide alternating access to fluid path 64 into fluid chamber 40, such that pressure fluctuations are applied to activation element 28. Referring to FIG. 3 and FIG. 4, it will be understood that the inner section 86 may not be a separate rotating valve element, and may instead be formed by a portion of sidewall 48 of tubular element 46. Referring to FIG. 5 through FIG. 8, outer section 84 may also take different forms, for example, carrying part of the opening to external port 78. Referring to FIG. 7 and FIG. 8, opening 94 may extend only a portion of the length of outer section 84, and referring to FIG. 5 and FIG. 6, there may not be an opening 94 along the length of outer section 84, depending on the application. It will be understood by those skilled in the art that other forms of sealing element 66 may be used as well.

In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The scope of the following claims should not be limited by the preferred embodiments set forth in the examples above and in the drawings, but should be given the broadest interpretation consistent with the description as a whole.

What is claimed is:

1. An axial vibration tool for a downhole tubing string, the axial vibration tool comprising:

an outer housing having a first end, a second end, and a longitudinal axis;

a flow control element carried within the outer housing;

a rotary motor connected to provide an actuation force to the flow control element when actuated;

a first flow path that passes from the first end to the second end of the outer housing, at least a portion of the first flow path being in fluid communication with the rotary motor and providing a continual flow of fluid that drives the rotary motor;

a shock tool carried by the outer housing, the shock tool having an activation element, the shock tool generating an oscillating force along its longitudinal axis based on fluid pressure applied to the activation element of the shock tool;

a high pressure flow path communicating fluid pressure between a source of high pressure fluid and the activation element; and a low pressure flow path communicating fluid pressure between a source of low pressure fluid and the activation element, the source of low pressure fluid being at a lower pressure than the source of high pressure fluid, the low pressure flow path separated from the high pressure flow path by the flow control element, wherein the flow control element alternatingly exposes the activation element to the high pressure flow path and the low pressure flow path to apply pressure fluctuations to the activation element as the flow control element is actuated by the rotary motor.

2. The axial vibration tool of claim 1, wherein the activation element is an annular piston positioned in an annular fluid chamber defined by an inner surface of the outer housing and an outer surface of an inner tubing string.

3. The axial vibration tool of claim 1, wherein the high pressure flow path comprises a central bore defined by the rotary motor that is separate from the first flow path and that bypasses a rotary or positive displacement portion of the rotary motor.

4. The axial vibration tool of claim 3, wherein the low pressure flow path comprises a port in the outer housing that is alternatingly opened and closed by the flow control element.

5. The axial vibration tool of claim 4, wherein the low pressure flow path is downstream of the rotary motor.

6. The axial vibration tool of claim 1, wherein the first flow path comprises the low pressure flow path, such that the fluid pressure is periodically vented by the flow control element to the first flow path.

7. The axial vibration tool of claim 1, wherein the first flow path comprises the high pressure flow path.

8. The axial vibration tool of claim 7, wherein the low pressure flow path is a port in the outer housing that is alternatingly opened and closed by the flow control element.

9. The axial vibration tool of claim 1, wherein the flow control element is a rotary control element that is rotatably mounted within the outer housing, the flow control element having a rotational axis that is parallel to the longitudinal axis of the outer housing.

10. The axial vibration tool of claim 9, wherein the flow control element comprises a tubular element having a sidewall and an internal bore, the sidewall comprising one or more radial ports that form part of the first flow path and that communicate fluid from the rotary motor to the internal bore of the tubular element.

11. The axial vibration tool of claim 10, wherein the sidewall of the flow control element comprises fluid passages that extend axially through the sidewall to communicate fluid from the high pressure flow path to the activation element.

12. The axial vibration tool of claim 10, wherein the tubular element of the flow control element comprises an end wall at an upstream end of the tubular element.

13. The axial vibration tool of claim 12, wherein the end wall comprises a nozzle that communicates fluid pressure from the high pressure flow path to the first flow path, the nozzle having a flow area.

14. The axial vibration tool of claim 13, wherein the flow area is adjustable.

15. The axial vibration tool of claim 13, wherein the nozzle is closeable.

16. The axial vibration tool of claim 15, wherein the nozzle acts as a fluid bypass between the first flow path and the high pressure flow path, and closing the nozzle activates the rotary motor, redirects fluid through the high pressure flow path, or both activates the rotary motor and redirects fluid through the high pressure flow path.

17. The axial vibration tool of claim 1, wherein the rotary motor is powered by one of a turbine and a progressive cavity pump.

18. The axial vibration tool of claim 1, wherein the flow control element controls flow through the high pressure flow path and the low pressure flow path.

19. A method of providing axial vibration to a downhole tool of a downhole tubing string, the method comprising the steps of:

in an axial vibration tool comprising:

an outer housing having a first end, a second end, and a longitudinal axis;

a flow control element carried within the outer housing;

a rotary motor connected to provide an actuation force to the flow control element when actuated;

a first flow path that passes from the first end to the second end of the outer housing, at least a portion of the first flow path being in fluid communication with the rotary motor;

a shock tool carried by the outer housing, the shock tool having an activation element, the shock tool generating an oscillating force along its longitudinal axis based on fluid pressure applied to the activation element of the shock tool;

a high pressure flow path in fluid communication with a source of high pressure fluid and the activation element; and a low pressure flow path in fluid communication with a source of low pressure fluid and the activation element, the low pressure flow path separated from the high pressure flow path by the flow control element;

causing fluid to flow along the low pressure flow path and the high pressure flow path, wherein the pressure of the low pressure flow path is less than the pressure of the high pressure flow path; and driving the rotary motor by providing a continual flow of fluid along the first flow path to actuate the flow control element, the flow control element alternatingly exposing the activation element to the high pressure flow path and the low pressure flow path to apply pressure fluctuations to the activation element.

20. The method of claim 19, wherein the low pressure flow path comprises a port in the outer housing, the method further comprising the step of alternatingly opening and closing the port in the outer housing using the flow control element.

21. The method of claim 19, wherein the end wall comprises a nozzle that communicates fluid pressure from the high pressure flow path to the first flow path, the nozzle having a flow area, the method further comprising the step of adjusting the flow area.

22. The method of claim 19, wherein the flow control element controls flow through the high pressure flow path and the low pressure flow path.

* * * * *